United States Patent [19]

Hamilton

[11] Patent Number: 5,028,325

[45] Date of Patent: Jul. 2, 1991

[54] WATER RAKE

[76] Inventor: William R. Hamilton, 3620 5th Ave., Corona Del Mar, Calif. 92625

[21] Appl. No.: 461,006

[22] Filed: Jan. 4, 1990

[51] Int. Cl.[5] ..... L02B 15/04

[52] U.S. Cl. ..... 210/242.1; 210/242.3; 210/923

[58] Field of Search ..... 210/242.1, 242.3, 242.4, 210/776, 923, 924

[56] References Cited

U.S. PATENT DOCUMENTS

| | | | |
|---|---|---|---|
| 3,314,545 | 4/1967 | Grabbe et al. | 210/242.3 |
| 3,546,112 | 12/1970 | Will et al. | 210/242.4 |
| 3,646,901 | 3/1972 | Budris et al. | 210/242.3 |
| 3,685,653 | 8/1972 | Van Stavern et al. | 210/242.3 |
| 3,700,108 | 10/1972 | Richards | 210/923 |
| 3,968,041 | 7/1976 | DeVoss | 210/242.3 |
| 4,033,869 | 7/1977 | McGrew | 210/242.3 |
| 4,128,068 | 12/1978 | Ogura et al. | 210/242.3 |
| 4,138,340 | 2/1979 | Suzuki et al. | 210/923 |
| 4,264,444 | 4/1981 | Bronnec | 210/923 |
| 4,322,294 | 3/1982 | Price | 210/242.3 |

*Primary Examiner*—Stanley Silverman
*Assistant Examiner*—Christopher Upton
*Attorney, Agent, or Firm*—Beach & Collins

[57] ABSTRACT

A craft which removes debris and chemicals from water having a wire conveyor that carries trash and other debris to a trash receptable as the conveyor moves through the water. The craft includes debris deflectors that channel the trash to a wire rope conveyor which is positioned between two large sponson floats which support the craft in water. The front of the conveyor system is submerged and the rear is above the water. The front of the conveyor system may be raised or lowered out of the water. A chemical pickup head system carries chemicals to a debris receptacle as the roller rotates in the water. A special surface is provided on the pick up head that collects the material by adhesion or absorption and carries it for removal by a rubber squeegee. A system for removing water from chemicals and redepositing water in the environment.

16 Claims, 6 Drawing Sheets

WATER RAKE

BACKGROUND OF THE INVENTION

1. Field of Invention.

The present invention relates to a device for the removing of pollution from water. The water rake refers specifically to an apparatus for removing trash and oil or other chemicals from waters including rivers, lakes, bays, harbors, and oceans. Depending on the size of construction of the water rake water may also include the high seas.

2. Description of Prior Art

Currently the pollution which is in rivers, lakes, and oceans is ignored or ineffectually handled. The trash and chemicals such as oil usually washes onto beaches or rocks and is then collected, or the trash and oil is often scooped up by someone in a boat using a net, scoop or other hand tool. The water rake enables trash and certain chemicals to be removed from waterways while the pollution is floating in the water. The water rake also removes significantly large amounts making it a more cost effective task.

SUMMARY OF OBJECTIVES OF THE INVENTION

A primary object of the present invention is to provide an effective means for removing trash, debris, and chemicals such as oil from water. The basic design uses a conveyor and roller system to collect pollution from a wide area.

In accordance with the description presented other objects of this invention will become apparent when the description and drawings presented are reviewed.

DESCRIPTION OF THE PREFERRED EMBODIMENT

The water rake collects trash and chemicals from rivers, lakes, bays, harbors, and oceans by using a conveyor-ramp and chemical pickup head design which moves in water. The conveyor and chemical pickup may be permanently attached to a boat; however, the chemical pick up head may be detached and installed when needed. The inventive idea is the combination of conveyor-ramp, trash collector, chemical pickup head, and boat design.

Figure 1:
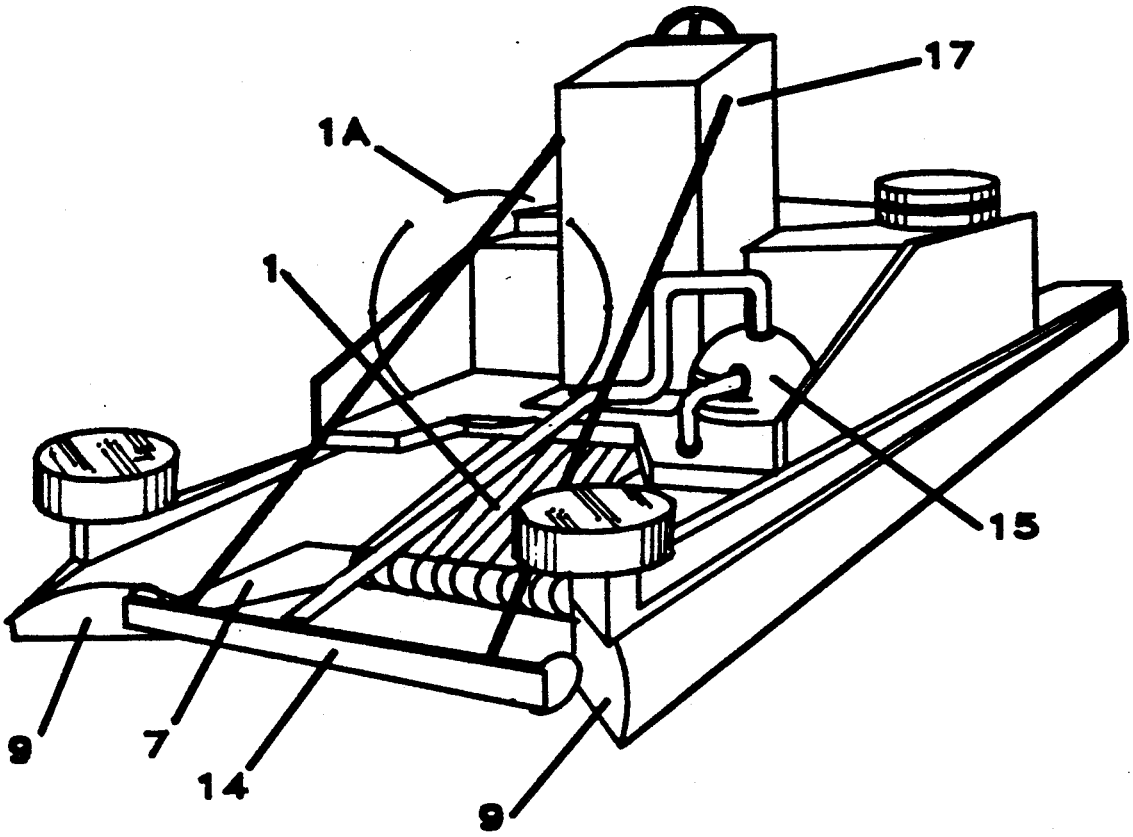
FIG. 1: Illustrates a perspective view of the front of the craft.
Figure 1A:
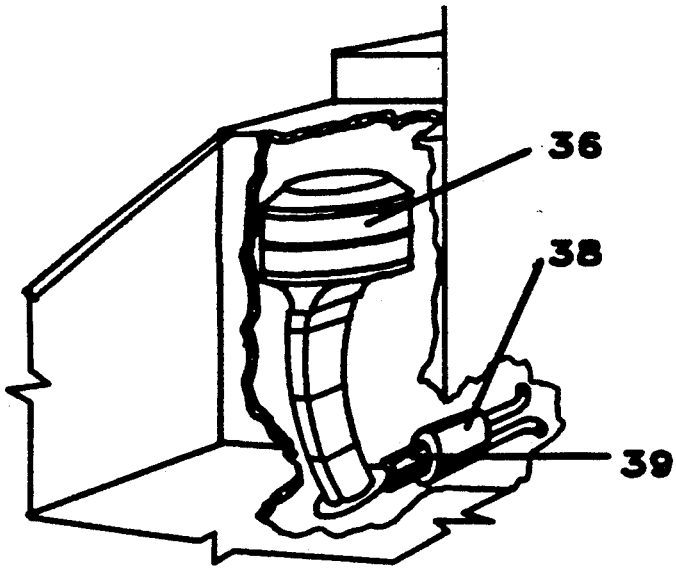
FIG. 1A: Illustrates the outboard motor hydraulic power system.

Referring to FIG. 1 trash is picked up on plastic-coated metal strands (1). The plastic coating on the metal stands (1) prevents rusting and enables a long life in water environments. The metal strands (1) are spaced one eighth inch apart to allow water and air to pass through. Although any number may be used, a ninety five cable belt conveyor system has been satisfactorily used. The metal strands (1) with this spacing easily retain trash, such as cigarettes. Other designs could allow the metal strands (1) to be separated further but the one eighth spacing has worked satisfactorily for most applications.

Figure 5:
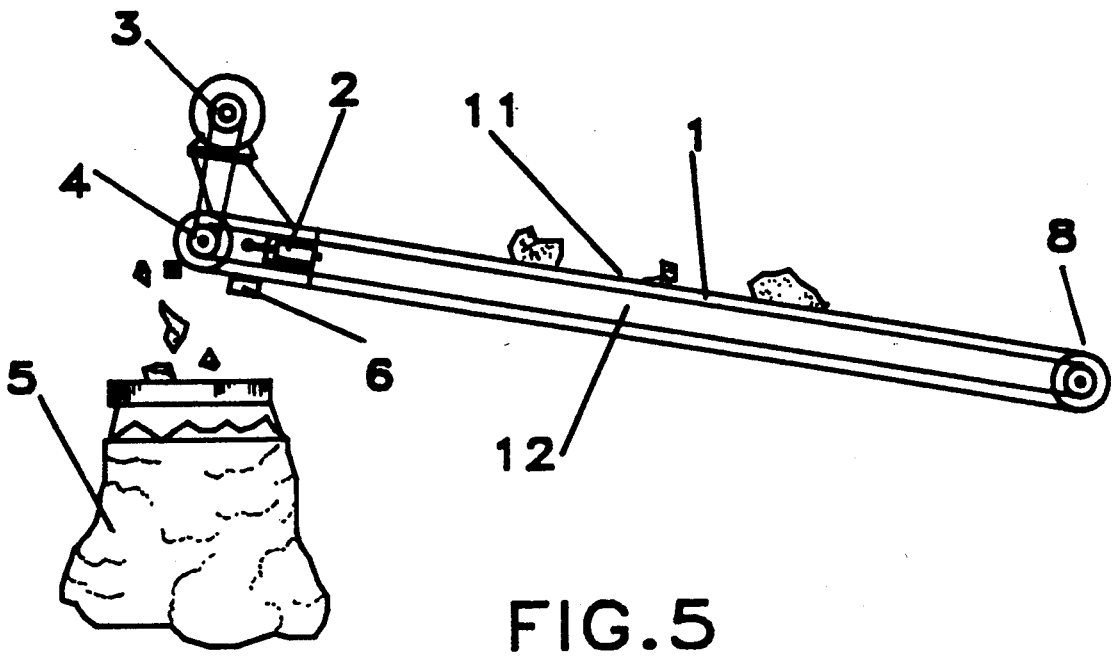
FIG. 5: Illustrates a side view of the conveyor system.
Figure 6:
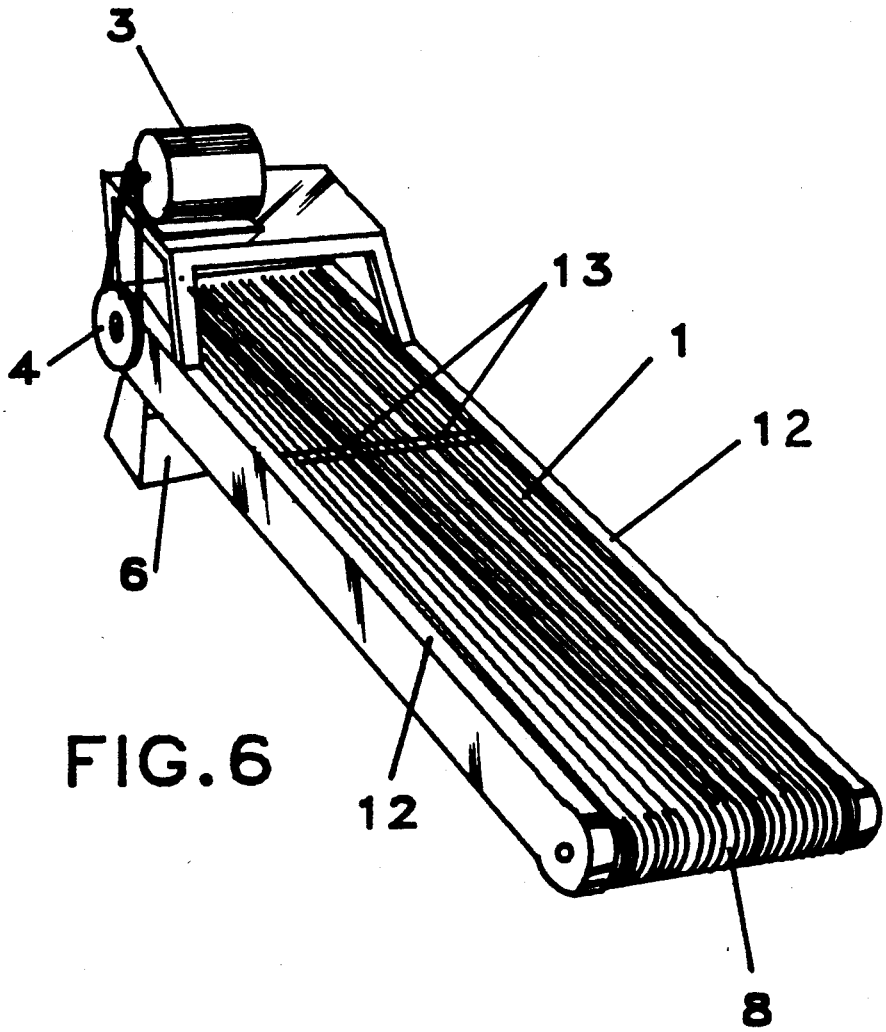
FIG. 6: Illustrates a front perspective view of the conveyor system.

As shown in FIGS. 5 and 6 the metal strands (1) move over a forward rotator (8) and a rear rotator (4). The rear rotator (4) is driven by an outboard motor (36), hydraulic transmission system and hydraulic motor (3) through a suitable belt or gear assembly. The forward rotator (8) is loose and rotates freely. The forward rotator (8) is submerged during operation. The rotators (4), (8) are grooved to maintain proper spacing of the plastic covered wire strands (1).

The wire stands (1) and rotators (4), (8) are supported by a conveyor belt track (12). Each side is connected by cross members (13) spaced such as to allow water and air to pass through. This also supports the conveyor tension control (2) which provides proper tension to the wire stands (1). Support of the trash while maintaining enough tension under a unloaded condition to keep the wire strands (1) moving in conveyor manner is required.

Figure 2:
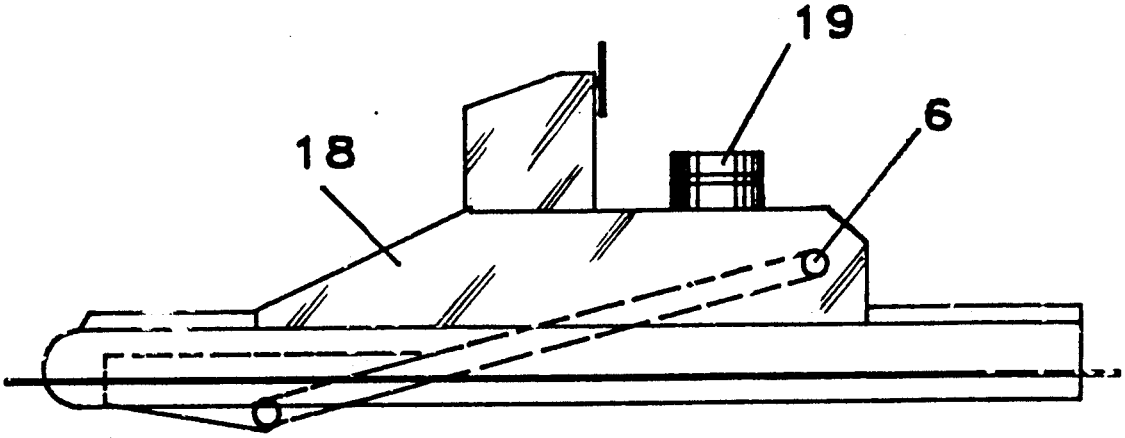
FIG. 2: Illustrates a side view of the water rake with conveyor system attached.
Figure 3:
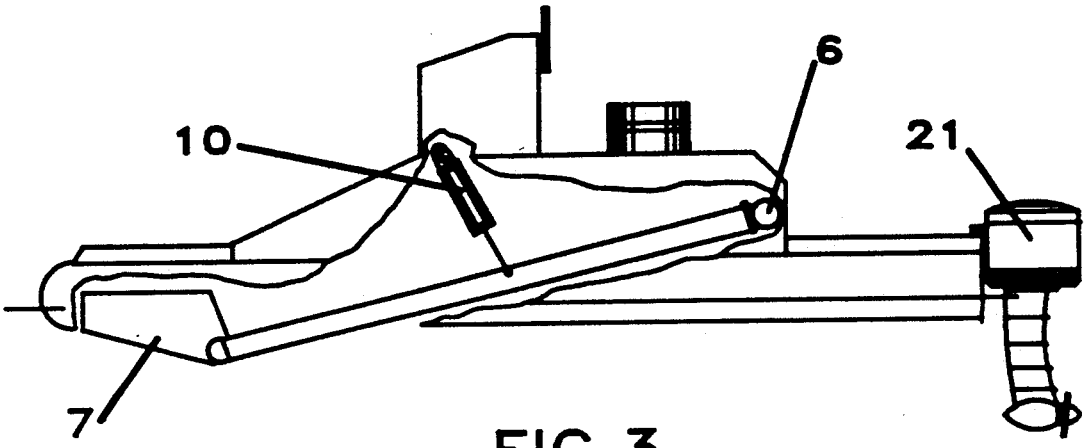
FIG. 3: Illustrates a cutaway view of the a side of the water rake displaying the conveyor system.

Referring to FIG. 2 and 3 the conveyor system is mounted on a pivot (6) at the rear of the craft and approximately three feet above the bottom of the craft. Hydraulic cylinders (10) are attached forward of the pivot (6) which allow an operator to lift the conveyor system out of the water when not collecting trash. This is especially convenient when cruising to the selected polluted area. The angle of inclination of the conveyor system is approximately fifteen to thirty degrees during operation and is adjustable. The hydraulic cylinders (10) allow the operator to maintain the proper height of the water rake in the water.

Figure 4:
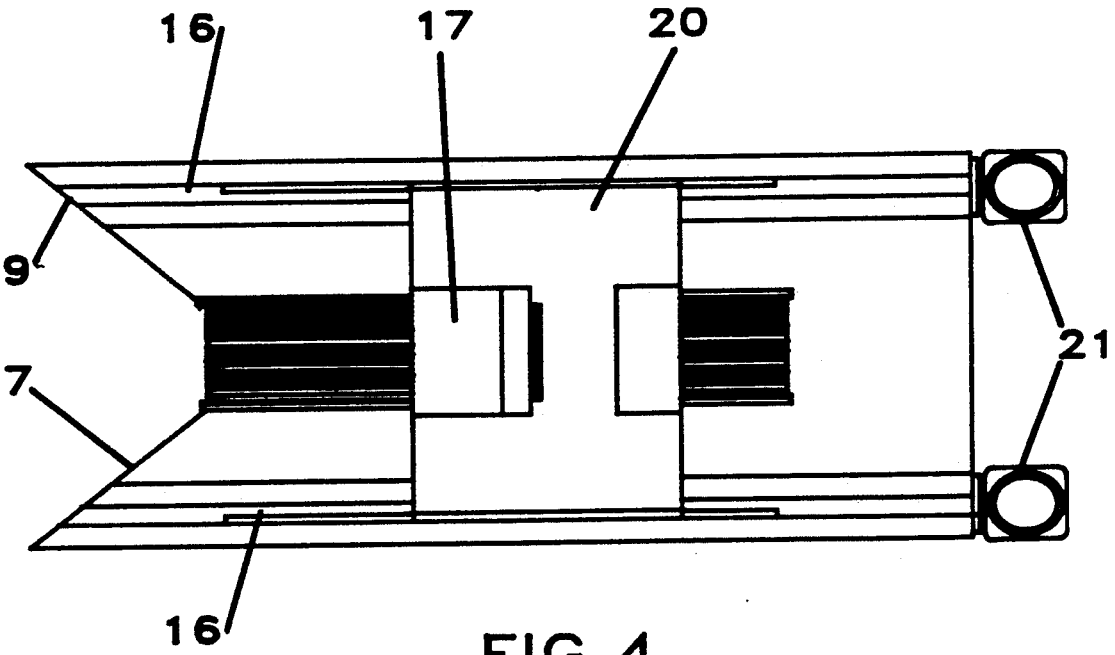
FIG. 4: Illustrates a top view of the craft.

As shown in FIG. 3 and 4 the design of the craft is such that the conveyor system sits between two sponson floats (16). The operator and steering column (17) are on a steering platform (20) which connect the sponson floats (16). The conveyor system is directly underneath the steering platform (20). Craft sides (18) support the hydraulic cylinder lifters (10). The pivot (6) about which the rear rotator (4) is supported is connected to the craft sides (18). Two outboard motors (21) each with six horse power propel the craft which weighs approximately fifteen hundred pounds. The craft travels up to five miles per hour with the conveyor system up and three miles an hour when the front of the conveyor system is down in the water.

Baffles (7) attached to the conveyor and which move up and down with the conveyor, guide trash from the bow area to the conveyor system. Referring to FIG. 4 the shape of the bow serves as debris deflectors (9) as an effective guide for trash. Also the venturi effect of water flowing between the forty five degree angle bows and baffles increases the flow of surface water near the front of the conveyor system. Everything that comes between the extreme points of the bows is picked up because of the craft's motion.

Spray jets (14) supplied with water by a water pump (15) force trash toward the conveyor system and are required when the craft does not have sufficient forward motion to place the trash on the metal strands. In addition debris deflectors (9) formed by the angles to the front of the foam sponsons (16) force trash from the sides into the front of the conveyor (1) to be picked up.

The rear rotator (4), water pump (15) and hydraulic lift cylinders (10) are powered by an outboard motor (36) with hydraulic pump (38) motors and control valves comprising the power transmission system on the side of the steering platform (20).

The fuel tank (19) is behind the steering column.

At the rear of the conveyor (1) is a trash collector (5) which collects the trash (11) which falls off the back of the conveyor system.

The conveyor design permits a wide variety of trash to be picked-up. Items from as small as a cigarette filter tip to larger items such as wood pieces are easily removed from water. Furthermore, the conveyor design is inherently nonfouling, self cleaning, and safe to operating personal since only smooth parallel plastic covered wires are used to transport the trash from water to the receptacle.

Figure 7:
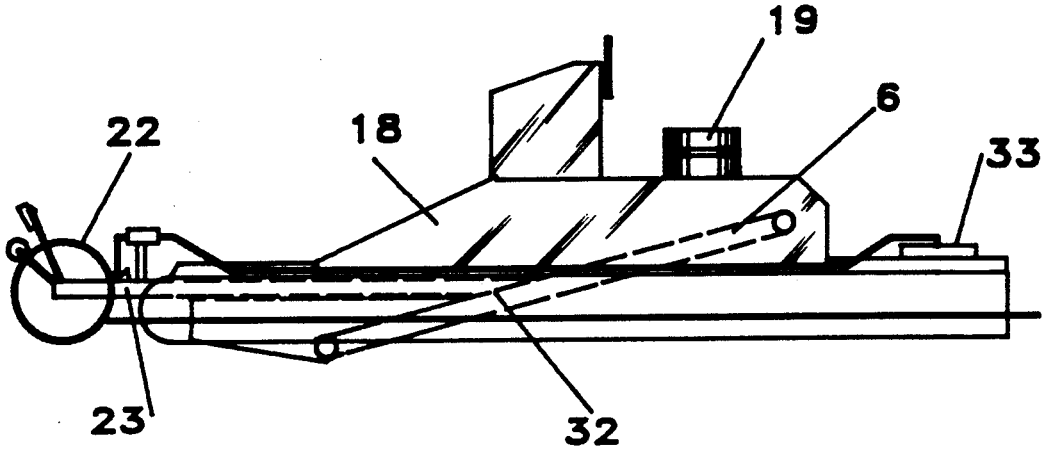
FIG. 7: Illustrates a side view of the water rake with conveyor system and chemical pickup head attached.

Referring to FIG. 7, a pick up head (22) is shown which, depending on the chemical and physical characteristic of the material to be removed, the pick up head (22) surface is covered with a material to which the chemical to be removed is attracted or adheres. The pickup head is attached to the water rake boat by the cantilevered frame (23) attached to the conveyor at point (32). This frame system (23) allows the pickup head (22) to be lowered into a chemical such as an oil slick over any chemical containment or other devices without breaking any containment barriers that may be in place. The chemical can also be safely picked up by placing the craft within the containment devices. When use of only the chemical pickup head system is desired, the conveyor system may be removed and a pickup frame extension (34) mounted at pivot (6) with cantilevered frame (23) attached at point (35).

The entire water rake boat and pickup head (22) can also be positioned in a chemical area and move around to pick up the contaminants.

Figure 8:
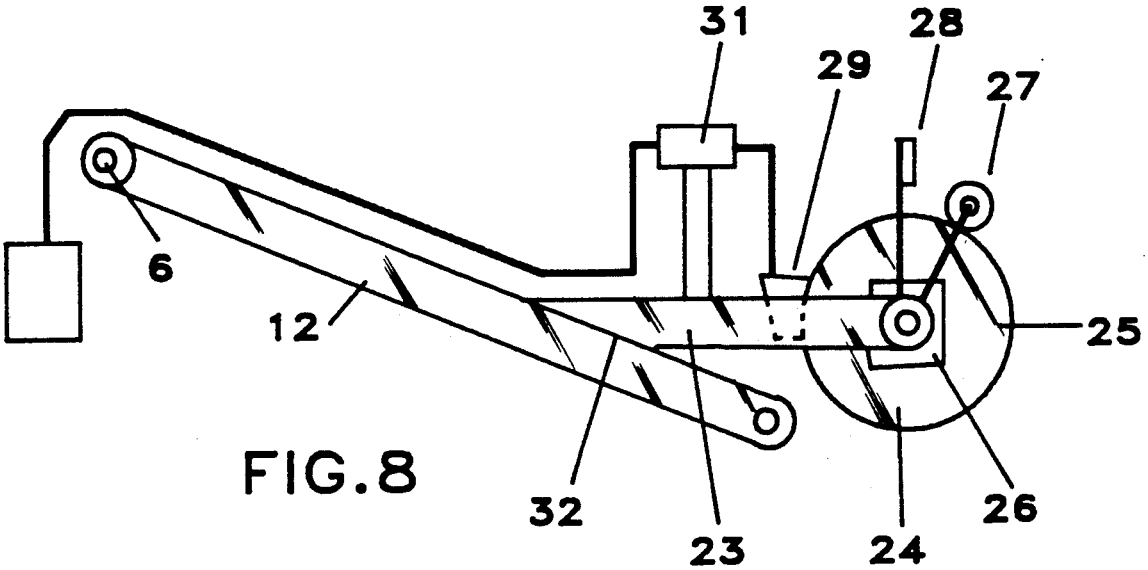
FIG. 8: Illustrates a side view of the chemical pickup system.

As shown in FIG. 8 the rotating drum (24) is caused to move in the chemical and water environment by the rotating drum motor (26). As the drum rotates the rotating drum chemical adhesion cover (25) pulls the contaminants out of the water as the chemical adheres to the rotating drum adhesion cover (25).

Figure 9:
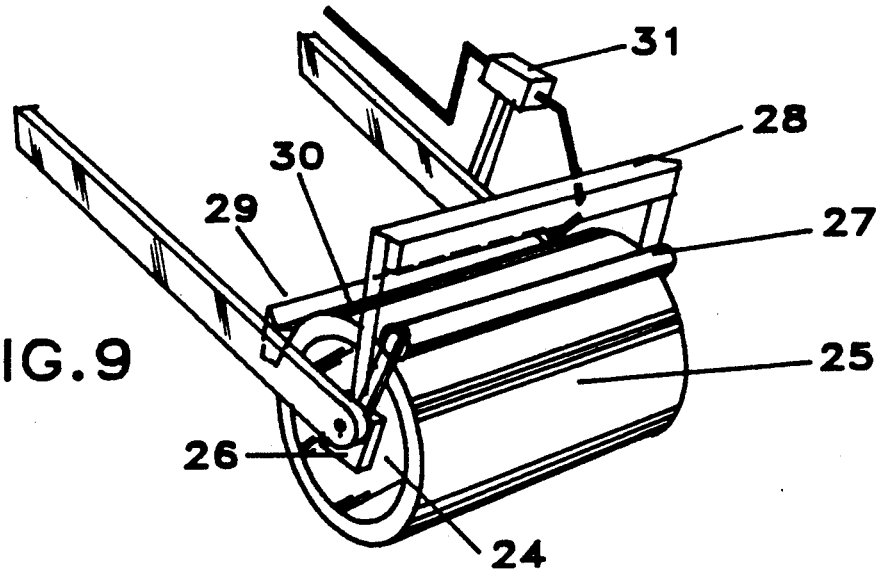
FIG. 9: Illustrates a front perspective view of the chemical pickup system.
Figure 10:
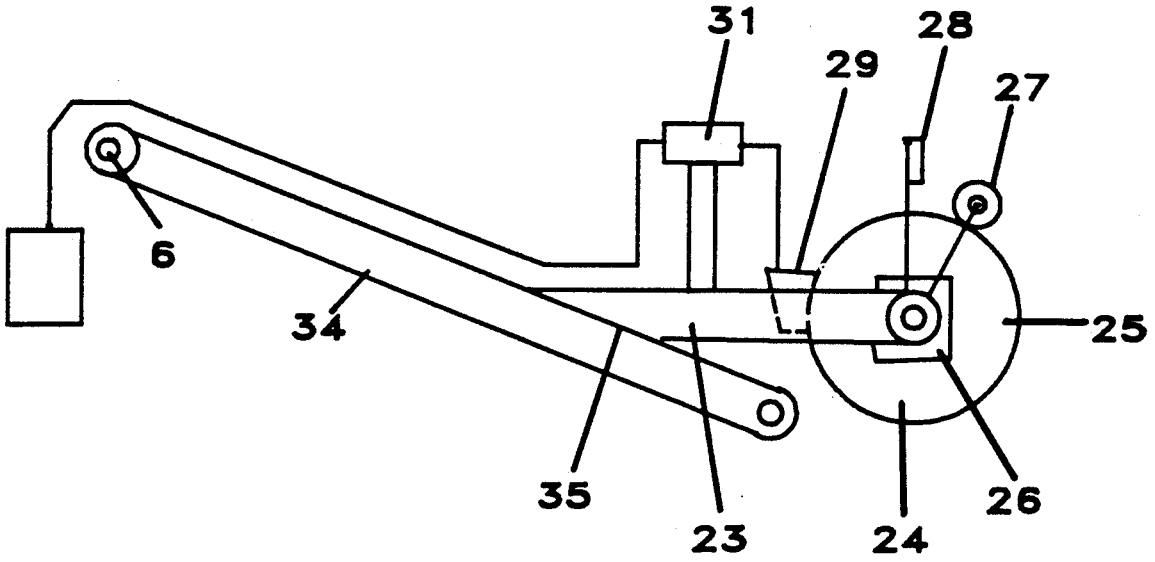
FIG. 10: Illustrates the chemical pickup head with the pickup frame extension.

Referring to FIG. 9, the squeegee (30) cleans the chemical off the surface of the rotating drum adhesion cover (25) into the chemical collection trough (29). The trough is sloped such that the chemical moves by force of gravity to the end of the trough by the removal pump (31). The removal pump (31) suctions the chemical out of the trough and pumps it to the back of the craft (33) to chemical debris containers.

The drum water remover (27) roller removes water from the rotating adhesion drum cover (25) and deposits it back in the environment. The drum water remover balance (28) serves to apply pressure to the rotating drum adhesion cover (25) at the proper pressure to remove the water from the chemical which then moves on to the squeegee (30).

Index

| Description | Number |
|---|---|
| Plastic-Coated Metal Strands | 1 |
| Conveyor Tension Control | 2 |
| Conveyor | 3 |
| Rear Grooved Conveyor Rotator | 4 |
| Trash Collector | 5 |
| Pivot | 6 |
| Baffles | 7 |
| Forward Grooved Conveyor Rotator | 8 |
| Debris Deflector | 9 |
| Hydraulic Cylinder Lifters | 10 |
| Trash | 11 |
| Conveyor Belt Track | 12 |
| Belt Cross Members | 13 |
| Spray Jets | 14 |
| Water Pump | 15 |
| Sponson Floats | 16 |
| Steering Column | 17 |
| Craft Sides | 18 |
| Fuel Tank | 19 |
| Steering Platform | 20 |
| Outboard Motors | 21 |
| Pickup Head | 22 |
| Pickup Frame | 23 |
| Rotating Drum | 24 |
| Rotating Drum Adhesion Cover | 25 |
| Rotating Drum Motor | 26 |
| Drum Water Remover | 27 |
| Drum Water Remover Balance | 28 |
| Oil Collection Trough | 29 |
| Squeegee to Remove Chemical | 30 |
| Chemical Removal Pump | 31 |
| Pickup Head Attachment Point | 32 |
| Debris Container | 33 |

I claim:

1. A craft which removes debris from water comprising:

a. a conveyor system having a plurality of plastic coated metal strands;

b. a forward rotator and a rear rotator around which the metal strands move in conveyor manner with each rotator being grooved so that a spacing of the metal strands is maintained;

c. a means for driving the rear rotator such that the rear rotator rotates to move the metal strands to convey trash;

d. a pivot located at the rear rotator;

e. a means for lifting and lowering the conveyor system;

f. two sponson floats sufficient to maintain the buoyant force on the craft;

g. a steering platform which connects the two sponson floats and maintains a spacing between the sponsons;

h. a craft side attached to the top of each of the sponson floats and to the steering platform where the pivot at the rear rotator is attached and where the means for lifting and lowering is attached;

i. a steering and control column on the steering platform and between the craft sides;

j. a debris deflector at the front of each sponson float and a baffle attached on each side of the front of the conveyor system so that trash is guided to the conveyor system;

k. a spray jet at the bow of the craft for forcing trash onto the conveyor system;

l. a water pump to supply the spray jet with high pressure water;

m. a means to power the conveyor system, the means for lifting and lowering, and the water pump;

n. one or more outboard motors to propel the craft;
o. a fuel tank; and
p. a trash collector at the rear of the conveyor.

2. A craft as in claim 1 wherein the means for powering comprises a hydraulic pressure system including a hydraulic lifter as the means for lifting and lowering and a hydraulic motor as the means for driving the rear rotator.

3. A craft as in claim 2 wherein the hydraulic pressure system is pressurized by use of an outboard motor to provide power to a hydraulic pump.

4. A craft as in claim 1 wherein the craft is propelled by two outboard motors with each outboard motor being attached to the rear of a sponson float.

5. A craft which removes debris from water comprising:

a. a conveyor system having a plurality of plastic coated metal strands;
b. a forward rotator and a rear rotator around which the metal strands move in conveyor manner with each rotator being grooved so that a spacing of the metal strands is maintained;
c. a means for driving the rear rotator such that the rear rotator rotates to move the metal strands to convey trash;
d. a pivot located at the rear rotator;
e. a means for lifting and lowering the conveyor system;
f. two sponson floats sufficient to maintain the buoyant force on the craft;
g. a steering platform which connects the two sponson floats and maintains a spacing between the sponsons;
h. a craft side attached to the top of each of the sponson floats and to the steering platform where the pivot at the rear rotator is attached and where the means for lifting and lowering is attached;
i. a steering and control column on the steering platform and between the craft sides;
j. a debris deflector at the front of each sponson float and a baffle attached on each side of the front of the conveyor system so that trash is guided to the conveyor system;
k. a spray jet at the bow of the craft for forcing trash onto the conveyor system;
l. a water pump to supply the spray jet with high pressure water;
m. one or more outboard motors to propel the craft;
n. a fuel tank;
o. a trash collector at the rear of the conveyor;
p. a chemical pickup head and a frame system attached to the conveyor system at a point to allow lowering in water with the conveyor system with the chemical pickup head having a plastic coated rotating drum;
q. a means to rotate the plastic coated rotating drum;
r. a squeegee system which removes chemical from the rotating drum and deposits it in a recovery trough that is sufficiently sloped to cause the chemical recovered to move toward a pickup point;
s. a hose and pump system with one hose end at the trough pickup point and with a debris container at the other end;
t. a means for removing water from the plastic coated drum; and
u. a means to power the conveyor system, the means for lifting and lowering, the water pump, the rotating drum, and the hose and pump system.

6. A craft as in claim 5 wherein the means to power comprises a hydraulic pressure system including a hydraulic lifter and the means for lifting and lowering, a hydraulic motor as the means for driving the rear rotator, and pressurization is by use of an outboard motor to provide power to a hydraulic pump.

7. A craft as in claim 5 wherein the craft is propelled by two outboard motors with each outboard motor being attached to the rear of a sponson float.

8. A craft as in claim 5 wherein the means to rotate the rotating drum is a variable speed hydraulic motor.

9. A craft as in claim 5 wherein the means to power the hose and pump system is a hydraulic suction pump.

10. A craft which removes chemicals from water comprising:

a. two sponson floats sufficient to maintain the buoyant force on the craft;
b. a steering platform which connects the two sponson floats and maintains a spacing between the sponsons;
c. a craft side attached to the top of each of the sponson floats and to the steering platform where a pivot at a pickup frame extension is attached and where a means for lifting and lowering is attached;
d. a steering column and controls on the steering platform and between the craft sides;
e. one or more outboard motors to propel the craft;
f. a debris container sufficient to collect the chemical removed;
g. a chemical pickup head and a frame system attached to the pickup frame extension at a point to allow lowering in water without breaking any containment means with the chemical pickup head having a plastic coated rotating drum;
h. a means to rotate the plastic coated rotating drum;
i. a squeegee system which removes chemicals from the rotating drum and deposits it in a recovery trough that is sufficiently sloped to cause the chemical recovered to move toward a pickup point;
j. a hose and pump system with one hose end at the trough pickup point and with a debris container at the other end;
k. a drum water remover roller with a drum water remover balance to apply sufficient pressure for removing water from the rotating drum;
l. a means to power the means for lifting and lowering, the rotating drum and the hose and pump system comprising a hydraulic transmission system, including a hydraulic lifter as the means for lifting and lowering, wherein pressurization of said hydraulic transmission system is by use of an outboard motor to provide power to a hydraulic pump;
m. a fuel containment system for the craft that provides fuel for each outboard motor and the means to power.

11. A craft as in claim 10 wherein the chemical pickup head is an oil pickup head with a polyvinyl chloride (PVC) coated rotating drum.

12. A craft as in claim 10 wherein debris deflectors located at the front of each sponson float are provided so that chemicals are guided to the plastic coated rotating drum.

13. A craft as in claim 10 wherein the craft is propelled by two outboard motors with each outboard motor being attached to the rear of a sponson float.

14. A craft as in claim 10 where is a spray jet at the bow of the craft forcing the containment into the chemical pickup head and a water pump to supply the spray jet at the bow with high pressure water.

15. A craft as in claim 10 wherein the means to rotate the rotating drum is a variable speed hydraulic motor.

16. A craft as in claim 10 wherein the means to power the hose and pump system is a hydraulic suction pump.

* * * * *